US011840900B2

(12) United States Patent
Karlsen et al.

(10) Patent No.: US 11,840,900 B2
(45) Date of Patent: Dec. 12, 2023

(54) WELL ABANDONMENT AND SLOT RECOVERY

(71) Applicant: ARDYNE HOLDINGS LIMITED, Aberdeen (GB)

(72) Inventors: Hans Christian Karlsen, Trondheim (NO); Eskild Storteig, Rognan (NO); Alagappan Vishwanathan, Aberdeen (GB); Michael Wardley, Aberdeen (GB); James Linklater, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 219 days.

(21) Appl. No.: 17/427,790

(22) PCT Filed: Feb. 13, 2020

(86) PCT No.: PCT/EP2020/053809
§ 371 (c)(1),
(2) Date: Aug. 2, 2021

(87) PCT Pub. No.: WO2020/165369
PCT Pub. Date: Aug. 20, 2020

(65) Prior Publication Data

US 2022/0127922 A1 Apr. 28, 2022

(30) Foreign Application Priority Data

Feb. 14, 2019 (GB) ..... 1902058
Aug. 26, 2019 (GB) ..... 1912225

(51) Int. Cl.
*E21B 31/00* (2006.01)
*E21B 28/00* (2006.01)
(Continued)

(52) U.S. Cl.
CPC ..... *E21B 31/005* (2013.01); *E21B 28/00* (2013.01); *E21B 31/113* (2013.01); *E21B 31/20* (2013.01)

(58) Field of Classification Search
CPC ..... E21B 31/005; E21B 28/00; E21B 31/113; E21B 31/20
See application file for complete search history.

(56) References Cited

U.S. PATENT DOCUMENTS 6,009,948 A * 1/2000 Flanders ..... E21B 33/14 166/177.2
6,279,670 B1 8/2001 Eddison et al.
7,077,205 B2 7/2006 Eddison

FOREIGN PATENT DOCUMENTS

WO WO 97/44565 11/1997
WO WO 2017/087110 A1 5/2017
(Continued)

OTHER PUBLICATIONS

Intellectual Property Office of the UK Patent Office; Search Report for GB1912225.8; five pages; dated Feb. 14, 2020; Intellectual Property Office of the UK Patent Office, Newport, South Wales, United Kingdom.

(Continued)

*Primary Examiner* — Robert E Fuller
(74) *Attorney, Agent, or Firm* — LAW OFFICE OF JESSE D. LAMBERT, LLC

(57) ABSTRACT

A vibratory casing recovery bottom hole assembly and a method of recovering casing in a wellbore. The vibratory casing recovery bottom hole assembly includes a casing spear, a flow modifier and a dynamic amplification tool. The flow modifier produces cyclic variations in fluid pressure through the assembly at a first frequency and the bottom hole assembly is configured to have a natural or resonant frequency when vibrated to be near or at the first frequency.

(Continued)

The dynamic amplification tool induces vibration in the bottom hole assembly while ensuring the dynamic amplification factor of the system is greater than one so as to transmit maximum vibration to the casing at the casing spear. Embodiments of dynamic amplification tools are described.

25 Claims, 3 Drawing Sheets

(51) Int. Cl.
*E21B 31/113* (2006.01)
*E21B 31/20* (2006.01)

(56) References Cited

FOREIGN PATENT DOCUMENTS

WO WO 2017/182549 A1 10/2017
WO WO 2018/203064 A1 11/2018

OTHER PUBLICATIONS

European Patent Office as ISA, International Search Report for PCT/EP2020/053809; dated Apr. 28, 2020; eleven pages; European Patent Office, Rijswijk, The Netherlands.

* cited by examiner 10
16
14
18
28
52
20
66
62
22
23
12
11
24

10
16
18
14
11
30
20
66
62
12
24
11
21
22

10
16
14
18
28
20
66
62
22
12
11
21
24

10
16
14
18
28
52
20
66
62
22
12
23
11
21
24

10
16
14
18
28
52
30
20
66
62
22
23
26
11
21
24

10
16
68
18
60
28
30
14
20
66
62
22
23
12
26
52
64
11
21
24

WELL ABANDONMENT AND SLOT RECOVERY

BACKGROUND OF THE INVENTION

The present invention relates to apparatus and methods for well abandonment and slot recovery and in particular, though not exclusively, to a vibratory casing recovery assembly and method of casing recovery using vibration.

When a well has reached the end of its commercial life, the well is abandoned according to strict regulations in order to prevent fluids escaping from the well on a permanent basis. In meeting the regulations it has become good practise to create the cement plug over a predetermined length of the well and to remove the casing. This facilitates a need to provide tools which can pull long lengths of cut casing from the well to reduce the number of trips required to achieve casing recovery. However, the presence of drilling fluid sediments, partial cement, sand or other settled solids in the annulus between the outside of the casing and the inside of a surrounding downhole body e.g. outer casing or formation can act as a binding material limiting the ability to free the casing when pulled. Stuck casings are now a major issue in the industry.

Traditionally, cut casing is pulled by anchoring a casing spear to its upper end and using the elevator/top drive on a drilling rig. However, some drilling rigs have limited pulling capacity, and when the casing may be stuck, there may be insufficient power at the spear to recover the stuck casing section. Consequently, further trips must be made into the well to cut the casing into shorter lengths for multi-trip recovery. As each trip into the well takes significant time and costs, techniques have been developed to reduce the number of trips into the well.

Vibration has been successfully used to assist in the removal of stuck objects in well bores. U.S. Pat. No. 7,077,205, the disclosure of which is incorporated herein in its entirety by reference, describes a method of freeing stuck objects from a bore comprising running a string into the bore, the string including a flow modifier, such as a valve, for producing variations in the flow of fluid through the string, and a device for location in the string and adapted to axially extend or contract in response to variations in the flow of fluid through the string. A portion of the string engages the stuck object. Fluid is then passed through the string while applying tension to the string, whereby the tension applied to the stuck object varies in response to the operation of the flow modifier and the extending or retracting device. This arrangement is offered as the Agitator™ to National Oilwell Varco, USA to assist in freeing a cut casing section when located below the casing spear.

A disadvantage in this approach is that the device which is adapted to axially extend or contract in response to variations in the flow of fluid is typically a shock sub which includes a spring. Those of skill in that art will note that shock subs are normally used for reducing shock and vibration-induced drilling string damage and bit wear. In such systems the spring is selected to provide a system having a natural frequency orders of magnitude lower than that of the frequency of vibrations expected to be experienced on the drill string. In this way, the vibrations experienced are a forcing frequency ($\Omega$) which induces vibration of the system at its natural frequency ($\omega$). Vibration theory teaches that the magnification ratio is at a maximum when $\Omega$=w and the system resonates. In shock subs the frequency ratio is designed to be much greater than one so that the dynamic amplification factor of the system, DAF<<1 so that the vibration is significantly reduced as it travels up the string. Accordingly, while the Agitator™ creates a forcing frequency with an input amplitude, the shock sub will effectively reduce the output amplitude which determines the variation in tension applied to the stuck object, due to the low DAF, providing an inefficient transfer of energy from the flow modifier to the stuck object.

It is also known to use resonance to free stuck drill pipes and other objects in wellbores as all stuck tubulars exhibit resonant frequencies that are a function of the free length of the tubular. U.S. Pat. No. 6,009,948 describes a system for performing a suitable operation in a wellbore utilizing a resonator. The system includes a resonator for generating pulses of mechanical energy, an engaging device for securely engaging an object in the wellbore and a sensor for detecting the response of the object to pulses generated by the resonator. The resonator is placed at a suitable location in the wellbore and the engaging device is attached to the object. The resonator is operated at an effective frequency to induce pulses into the object. The sensor detects the response of the object to the induced pulses, which information is utilized to adjust the operating frequency. In such a system the resonator must be selected to have a sufficient frequency range and must be capable of switching frequencies in the wellbore. Further the system requires electrical connections so that the sensor can operate and feedback signals to the resonator to change frequency. Such a system is therefore expensive and requires trained technicians to operate at a well.

It is an object of the present invention is to provide a vibratory casing recovery assembly which obviates or mitigates at least one of the disadvantages of the prior art.

It is a further object of the present invention to provide a method for casing recovery which obviates or mitigates at least one of the disadvantages of the prior art.

SUMMARY OF THE INVENTION

According to a first aspect of the present invention there is provided a vibratory casing recovery assembly, comprising:

a bottom hole assembly (BHA), configured to be suspended from an anchor mechanism on a fluid carrying string, the BHA comprising:

a flow modifier for producing cyclic variations at a first frequency in the pressure of fluid through the string, and a dynamic amplification tool adapted to cause axial movement in the bottom hole assembly in response to variations in the flow of fluid through the string;

the dynamic amplification tool being arranged between the anchor mechanism and the flow modifier; and the dynamic amplification tool being configured to provide a natural resonant frequency in the bottom hole assembly wherein:

$$0.6<\text{first frequency}/\text{natural frequency}<1.2$$

to provide a dynamic amplification factor of >1.

In this way, the bottom hole assembly is tuned to be at or near the frequency of the flow modifier so that the system operates near resonance. Consequently, there is a magnification of the amplitude of variation on the tension applied to the casing to be removed which aids casing recovery.

Preferably, 0.9<first frequency/resonant frequency<1.1. In this way, the bottom hole assembly is tuned to be close to the frequency of the flow modifier so that the system operates near resonance providing a dynamic amplification factor much greater than 1.

By making the natural or resonant frequency at or near the first frequency and thereby tuning the BHA to the frequency of the flow modifier, the dynamic amplification factor of the bottom hole assembly is maximised thereby maximising the vibration experienced by the cut section of casing at the gripping point to the anchor mechanism.

The flow modifier may comprise an oscillating or rotating member, and is preferably in the form of a rotating valve, such as described in WO97/44565, the disclosure of which is incorporated herein by reference, although other valve forms may be utilised. The rotating valve may be driven by an appropriate downhole motor powered by any appropriate means, or a turbine, and most preferably by a fluid driven positive displacement motor (PDM). The flow modifier may be the Agitator™ supplied by National Oilwell Varco.

The dynamic amplification tool comprises a tool body having a first end and a second end each configured for connection into the bottom hole assembly, a tool body including a chamber, the chamber including at least one inlet and at least one outlet to provide a fluid passageway through the dynamic amplification tool, between the first end and the second end, and the chamber includes at least one wall on which modified fluid flow can act.

In this way, pressure pulses induced in the fluid flow enter a chamber in the tool and act against at least one surface to transmit energy into the bottom hole assembly at the first frequency. This induced movement will cause the dynamic amplification tool to vibrate and with it, the bottom hole assembly. There is no damping applied, as would be experienced in a shock sub, so that the vibration is amplified by use of the chamber.

Preferably, the at least one wall is arranged substantially perpendicular to a longitudinal axis of the dynamic amplification tool and the bottom hole assembly. In this way, the pressure pulses act directly on the wall as fluid flow is against and normal to the wall.

Preferably, there is a first wall and a second wall of the chamber, the walls being arranged opposite each other. More preferably the first and second walls are perpendicular to the longitudinal axis of the dynamic amplification tool and the bottom hole assembly. In this way, the pressure pulses are reflected from the first wall and then pass back and forth between the first and second walls to create the vibrations and resonance in the bottom hole assembly.

Preferably the chamber has a side wall connecting the first and second walls. Preferably the side wall is substantially parallel to the longitudinal axis of the dynamic amplification tool and the bottom hole assembly. Preferably the chamber has a cross-sectional area, perpendicular to the longitudinal axis, which is greater than the cross-sectional flow area of in the remainder of the tool body. The increased volume in the chamber compared to the bore of the string increases the efficiency in which the pressure pulses are captured in the dynamic amplification tool. There may be a plurality of chambers in the dynamic amplification tool. In this way, the dynamic amplification factor can be increased over a shorter length of bottom hole assembly.

Advantageously, a stiffness of the dynamic amplification tool is tuned, together with the mass of the bottom hole assembly, to select the natural frequency. In this way, the first frequency is known and the natural frequency is selected. Alternatively, or additionally, a length of the bottom hole assembly between the anchor mechanism and the flow modifier can be selected to assist in resonating the bottom hole assembly at the natural frequency. The length may be made up by selecting a length of the chamber together with one or more pipe sections in the bottom hole assembly. along the longitudinal axis. The pipe sections may be any tubulars such as drill pipe or casing. Individual drill pipe joints are manufactured in nominal 31.6 ft (9.65 m) lengths. The pipe is typically handled at surface in three-joint stands (or "triples") for speed in running, pulling, and storing the pipe. The joints may also be referred to as drill collars. Heavy weight drill pipe may be used to increase the mass of the bottom hole assembly to reduce stress on the bottom hole assembly when vibrated. Casing sections more typically are thicker walled and come in 42 ft (13 m) lengths, with a three-joint stand also being provided, now with a longer length.

The side wall of the chamber is preferably provided by a cylindrical tube. In this way, the dynamic amplification tool can be provided by a simple sub or one or more sections of pipe in which a first wall is provided at an end thereof. In an embodiment, there may be six joints of pipe section between the flow modifier and the anchor mechanism. More preferably a portion of the pipe section is casing section. Preferably, the chamber length is tuned to be a portion of the wavelength of the speed of sound in the fluid. More preferably the chamber length is an integer number of half wavelengths. The chamber length may be an integer number of quarter wavelengths. In this embodiment, it is the length of the bottom hole assembly which is designed to resonate at a natural frequency which is tuned to the first frequency.

Alternatively, the second wall may be arranged to act on a spring. The chamber of the bottom hole assembly will be selected to provide a desired stiffness which is tuned to the first frequency (along with mass suspended below).

In an embodiment, the spring is a machined spring arranged around an outside of the side wall. In this way, the stiffness of the spring is tuned to the first frequency (along with mass). Advantageously, the machined spring part of the dynamic amplification tool can take tension as well as compression, unlike conventional tools. In this way, higher oscillatory loads can be applied before failure occurs. The introduction of a spring reduces the length of the bottom hole assembly required as there is no requirement on the length and sections of pipe are not required. In this way, a bottom hole assembly of less than one stand can be provided for ease of handling at surface.

In an alternative embodiment, the side wall is a set of bellows. In this way, the undulating wall configuration will act as a spring while containing the chamber therein. Additionally, the stiffness of the bellows can be tuned to the first frequency (along with mass). Advantageously, the spring part of the bellows can take tension as well as compression, unlike conventional tools. In this way, higher oscillatory loads can be applied before failure occurs. The introduction of a spring part reduces the length of the bottom hole assembly required. In this way, a bottom hole assembly of less than one stand can be provided for ease of handling at surface. Preferably, a profile of the side wall is designed and wall thickness is varied to achieve the correct stiffness with the minimum stress.

The bottom hole assembly may include a casing cutter. In this way, casing can be cut on the same trip as the cut casing is recovered.

The vibratory casing recovery assembly may include the anchor mechanism. More preferably the anchor mechanism is a casing spear.

These are known in the art for pulling cut sections of casing.

The vibratory casing recovery assembly may include a downhole pulling tool on the string above the anchor mechanism. In this way, a high static load can be applied to the casing during recovery to assist in releasing the casing.

According to a second aspect of the present invention there is provided a method of casing recovery in a wellbore, comprising the steps;

(a) running a string into the wellbore, the string including a vibratory casing recovery bottom hole assembly according to the first aspect;

(b) setting the anchor mechanism to an inner wall of the casing;

(c) pumping fluid from surface through the string to produce cyclic variations at the first frequency in the pressure of fluid through the string to induce vibration in and resonance of the bottom hole assembly; and (d) pulling the string and the vibratory casing recovery bottom hole assembly to recover the casing to be removed.

In this way, as the bottom hole assembly is tuned to be at or near the frequency of the flow modifier, the system operates near resonance providing a DAF>1. Consequently there is a magnification of the amplitude of variation on the tension applied to the casing to be removed which aids casing recovery.

Preferably, the bottom hole assembly is configured to have a resonant frequency when vibrated wherein:

$$0.9 < \text{first frequency}/\text{resonant frequency} < 1.1.$$

By making the natural or resonant frequency at or near the first frequency and thereby tuning the elements to the frequency of the flow modifier, the dynamic amplification factor of the bottom hole assembly is maximised thereby maximising the vibration experienced by the cut section of casing at the anchor point to the anchor mechanism.

The method may include the step of varying the fluid flow rate through the string. In this way, the first frequency can be adjusted in use to fine tune the resonance point and match the natural frequency to the first frequency.

The method may include providing a downhole pulling tool on the string above the anchor mechanism and using the downhole pulling tool to pull the bottom hole assembly and casing to be recovered before pulling the string to recover the casing. In this way, a high static load can be applied to the casing to be recovered which aids in releasing the casing.

The method may include the additional steps of providing a casing cutter in the bottom hole assembly and cutting casing to provide a cut section of casing to be removed on the same trip as recovering the casing.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

It is also realised that terms such as 'above' and below' are relative and while the description assumes a perfectly vertical wellbore, the invention can be used on deviated wellbores.

BRIEF DESCRIPTION OF THE DRAWINGS

Embodiments of the present invention will now be described, by way of example only, with reference to the accompanying drawings of which.

DETAILED DESCRIPTION OF THE INVENTION

Figures 1A, 1B, 1C, 1D, 1E, 1F:
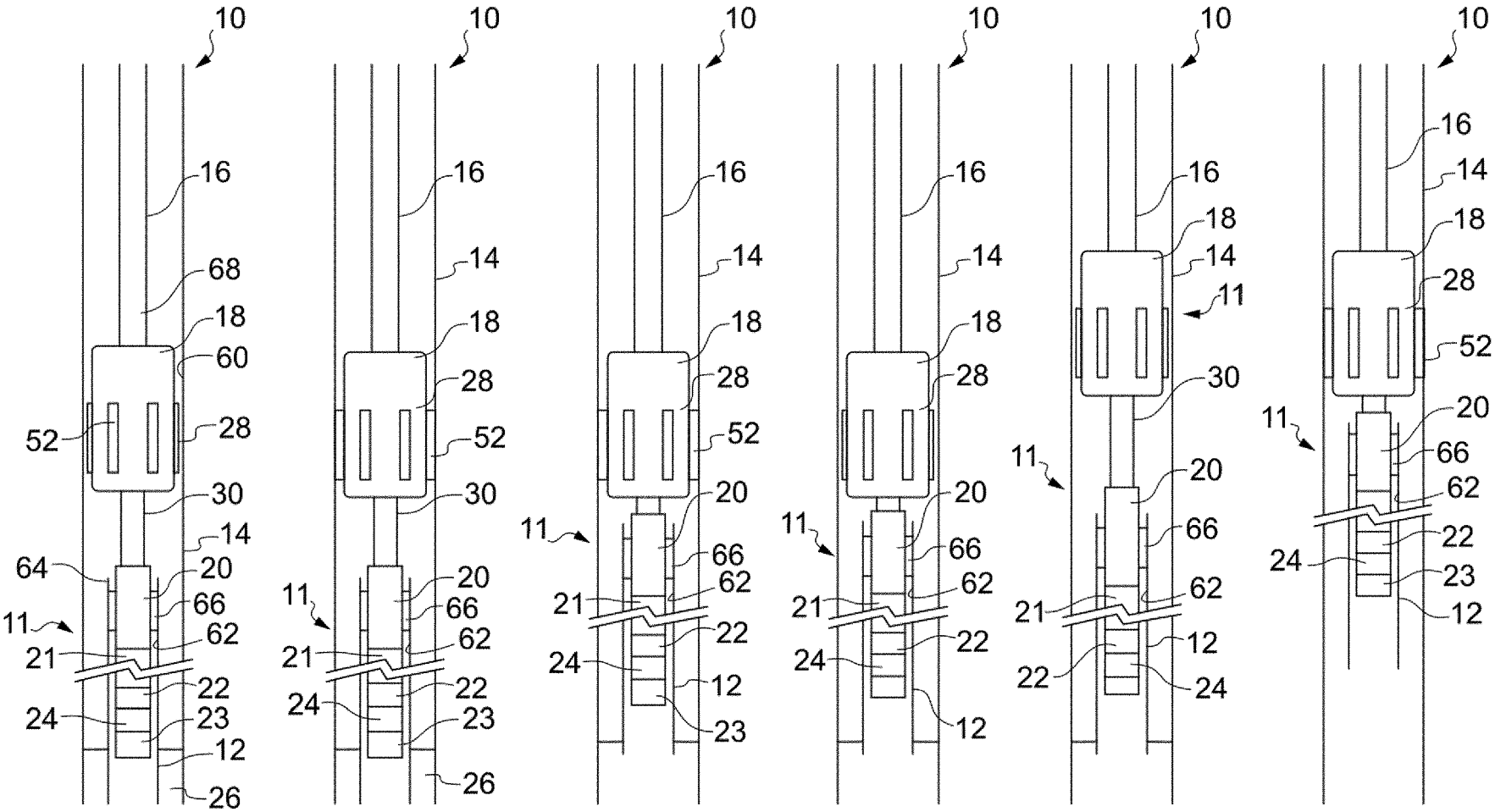
FIGS. 1(*a*) to 1(*f*) illustrate apparatus and method for casing recovery in a wellbore, using a vibratory casing recovery bottom hole assembly, according to an embodiment of the present invention.

Reference is initially made to FIG. 1 of the drawings which illustrates a method of recovering casing from a well using a vibratory casing recovery bottom hole assembly, according to an embodiment of the present invention. In FIG. 1(*a*) there is shown a cased well bore, generally indicated by reference numeral 10, in which a length of casing 12 requires to be recovered. A tool string 16 including a vibratory casing recovery bottom hole assembly 11 is run in the well 10. Apparatus 11 includes a casing spear 20, a dynamic amplification tool 22 and a flow modifier 24 arranged in order on the bottom of the drill string 16. Optionally, a number of pipe sections 21 (one shown) can be located between the casing spear 20 and the dynamic amplification tool 22 to provide a desired length between the casing spear 20 and flow modifier 24; a downhole pulling tool 18 can be located above the casing spear 20; and a casing cutter 23 located below the flow modifier 24. Other elements such as a pressure drop sub may also be located on the string 16 and form part of the vibratory casing recovery bottom hole assembly 11.

The tool string 16 is a drill string typically run from a rig (not shown) via a top drive/elevator system which can raise and lower the string 16 in the well 10. For this example, the well 10 has a second casing 14, though this need not be the case. Casing 14 has a greater diameter than casing 12. In an embodiment, length of casing 12 is 9⅝" diameter while the outer casing is 13⅜" diameter.

Casing 12 will have been cut to separate it from the remaining casing string. In an embodiment the vibratory casing recovery bottom hole assembly 11 includes a casing cutter 23 and the casing 12 is cut on the same trip into the well 10 as that to recover it. The cut section of casing 12 may be over 100 m in length. It may also be over 200 m or up to 300 m. Behind the casing 12 there may be drilling fluid sediments, partial cement, sand or other settled solids in the annulus between the outside of the casing 12 and the inside of a surrounding downhole body, in this case casing 14 but it may be the formation of the well 10. This material 26 can prevent the casing 12 from being free to be pulled from the well 10. It is assumed that this is the position for use of the present invention.

Casing spear 20 operates to grip the inner surface 62 of the length of casing 12. The casing spear anchors via an anchor or gripping mechanism being slips 66 designed to ride up a wedge and by virtue of wickers or teeth on its outer surface grips and anchors to the inner surface 62 of the casing 12. The casing spear 20 includes a switch which allows the casing spear to be inserted into the casing 12 and hold the slips in a disengaged position until such time as the grip is required. At this time, the casing spear 20 is withdrawn from the end 64 of the casing 12 and, as the switch exits the casing 12, it automatically operates the slips which are still within the casing 12 at the upper end 64 thereof. This provides the ideal setting position of the spear 20. In a preferred embodiment the casing spear 20 is the Typhoon® Spear as provided by Ardyne AS. The Typhoon® Spear is described in WO2017/059345, the disclosure of which is incorporated herein in its entirety by reference.

The flow modifier 24 is a circulation sub which creates fluid pulses in the flow passing through the device. This can be achieved by a rotating member or a rotating valve. In the embodiment shown the flow modifier 24 contains a positive displacement motor (PDM) and a rotating valve, such as described in WO97/44565, the disclosure of which is incorporated herein by reference. The valve includes a valve member which is rotated or oscillated about a longitudinal axis by the PDM and in doing so varies the flow area of the valve. This creates a cyclical or periodic variation in the fluid flow at a frequency. This frequency is determined by the size of plates or valve members and is typically 15 to 20 Hz.

In a preferred embodiment the flow modifier 24 is the Agitator™ System available from National Oilwell Varco. It is described in U.S. Pat. No. 6,279,670, the disclosure of which is incorporated herein in its entirety by reference. The use of the flow modifier 24 has been described in conjunction with a shock sub in U.S. Pat. No. 7,077,295, the disclosure of which is incorporated herein in its entirety by reference. In U.S. Pat. No. 7,077,295, the cyclic variation in the flow modifier is used to induce an axial variation in the shock sub at the same frequency. However, the spring within the shock sub will have its own natural frequency or resonant frequency determined by its design (spring constant) and the mass it carries. In standard shock subs used to reduce the transmission of vibrations up a drill string, the spring is deliberately selected so that the natural or resonant frequency ($\omega$) is far away, typically at least 20 times, different than that of the frequency of vibration, forced frequency ($\Omega$) expected to be experienced. This coupled with the floating piston in fluid acts to dampen the vibrations being transmitted up the string. Using classic forced damped mechanics, with a standard shock sub having a spring with a natural frequency of 8 Hz, the dynamic amplification factor ((dynamic load+static load)/(static load)), DAF=~0.4. Meaning that the output amplitude is only 40% of the input amplitude across the shock sub.

Figure 2:
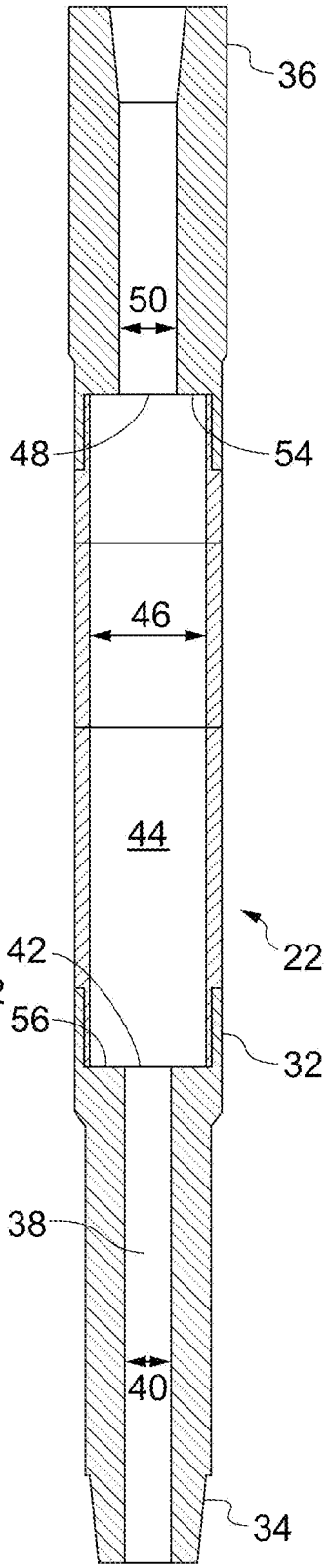
FIG. 2 is a schematic sectional view of a dynamic amplification tool according to an embodiment of the present invention.

In contrast, for the present invention, above the flow modifier 24 is a dynamic amplification tool 22, as schematically illustrated in in FIG. 2. The dynamic amplification tool is designed to provide a DAF of greater than one in the system 11 when vibrated at the frequency of fluid from the flow modifier 24. The dynamic amplification tool 22 comprises a substantially cylindrical tool body 32, having a first end 34 and a second end 36 configured to connect to adjacent sections of tubular, the casing spear 20 or the flow modifier 24, respectively. The first end 34 is shown as a pin section and the second end 36 is shown as a box section. A box and pin coupling is as known in the art. From the first end is a central bore 38 arranged along the longitudinal axis of the tool 22. The central bore has a first diameter 40 and provides an inlet 42 to a chamber 44. Chamber 44 is cylindrical having a second diameter 46 which is greater than the first diameter 40 at the inlet 42. Towards the second end 36, the chamber 44 has an outlet 48, with a third diameter 50, being smaller than the second diameter 46 of the chamber 44. In the embodiment shown, the first diameter 40 and third diameter 50 are the same. The tool body 32 can be formed as a unitary piece or have any number of elements. Three elements are shown in FIG. 2. The number of connections and wall thicknesses are selected to extend the fatigue life of the tool 22, which will undergo stress from being vibrated at resonance at natural or resonant frequency ($\omega$) equal to that of the frequency of the flow from the flow modifier 24, which may be considered as the forced frequency ($\Omega$). Due to the increased diameter 46 and cross-sectional flow area of the chamber 44, a first wall 54 is created at the outlet 48. The first wall 54 has an annular face and is arranged to be perpendicular to the longitudinal axis through the tool 22. Fluid flow through the tool 22 via the bore 38 and into chamber 44 is captured by the wall 54 and with an opposing second wall 56 at the inlet 42, a standing wave can be established. Pressure pulses created by modifying the fluid at a forced frequency are reflected between the walls 54,56.

In the embodiment shown in FIG. 2, the side wall 55 is formed as a rigid cylindrical tube. A standing wave is created by defining the length of the chamber 44 between the walls 54,56 to be a portion of the wavelength of the speed of sound in the fluid. Ideally the length is an integer number of half wavelengths, but could be an integer number of quarter wavelengths. This provides an 'out of phase' configuration. The walls 54,56 are also profiled to prevent destructive reflections occurring at the faces. Unlike the shock sub, the dynamic amplification tool 22 has no moving parts and so provides minimal damping. The tool 22 has a clear passageway for fluid flow through the tool 22 and this also minimises damping. To match the natural or resonant frequency to the first frequency, for the bottom hole assembly, the length of the assembly 11 can be varied. This is achieved by adding pipe section 21 between the casing spear 20 and the dynamic amplification tool 22 to provide an optimum length of the bottom hole assembly 11. The chamber 44 has been found to enhance the dynamic amplification factor of the tuned bottom hole assembly 11. The pipe section 21 used can be any tubular such as drill pipe or casing sections. Casing sections are favoured as the heavier gauge provides increased resistance to stress and fatigue resulting from the vibration in the assembly at resonance.

One will realise that providing a length of connecting pipe between the casing spear 20 and the flow modifier 24, which includes a narrowed section to provide a wall, may act as the dynamic amplification tool 22. This connecting pipe may be formed as one or more pipe sections 21 or joints of tubing such as drill collars, casing sections or drill pipe. In an embodiment there are six pipe sections. Good results were obtained when two joints of the six were casing and in other studies four joints were casing, the remaining joints being drill collars. As above, it is the length which is required over the weight, so that heavier gauge such as heavy weight drill pipe or casing can be used to increase the resistance to stress and fatigue in use. The distance between the anchor point of the slips 66 and the flow modifier 24, can be adjusted by increasing and decreasing the length of pipe section 21. This length can be set to create resonance along the pipe sections 21 which is at a natural resonant frequency equal to the frequency of the output of the flow modifier 24. At an end of the pipe sections 21, the central bore will be narrowed so as to provide the first wall 54 at an outlet, so that the lengths of pipe section create the chamber 44 within the bore thereof. An increase in the central bore on exit from the modifier 24 will act as the inlet and create the second wall 56. By tuning this dynamic amplification tool 22 of pipe sections 21 to the forced frequency of the flow modifier 24, the dynamic amplification factor can be increased so as to maximise the vibrational energy transmitted with the minimum losses to the casing 12. Typically, six to eight pipe sections have been required to provide the correct natural frequency. Preferably there are six casing sections. Alternatively, there may be eight drill pipe sections. This provides a bottom hole assembly 11 which is greater than a stand in length.

In an alternative embodiment, the dynamic amplification tool 22 includes a spring. The natural frequency, ω, will then be determined by the spring and the tools suspended from being considered as a spring-mass system.

Standard vibration theory gives a relationship of:

$$\omega=(1/2\pi)\times(k/m)^{0.5}$$

were k is the stiffness of the assembly and m is the mass of the suspended tools. When the system is subjected to a forced frequency Ω, being the frequency of the cyclic variation in pressure from the flow modifier 24, the amplitude of vibrations in the system will be determined from the magnification ratio M and the damping ratio ζ, according to the classic relationship:

$$M=1/\{[1-(\Omega/\omega)^2]^2+4\zeta^2(\Omega/\omega)^2\}^{1/2}$$

Figure 3:
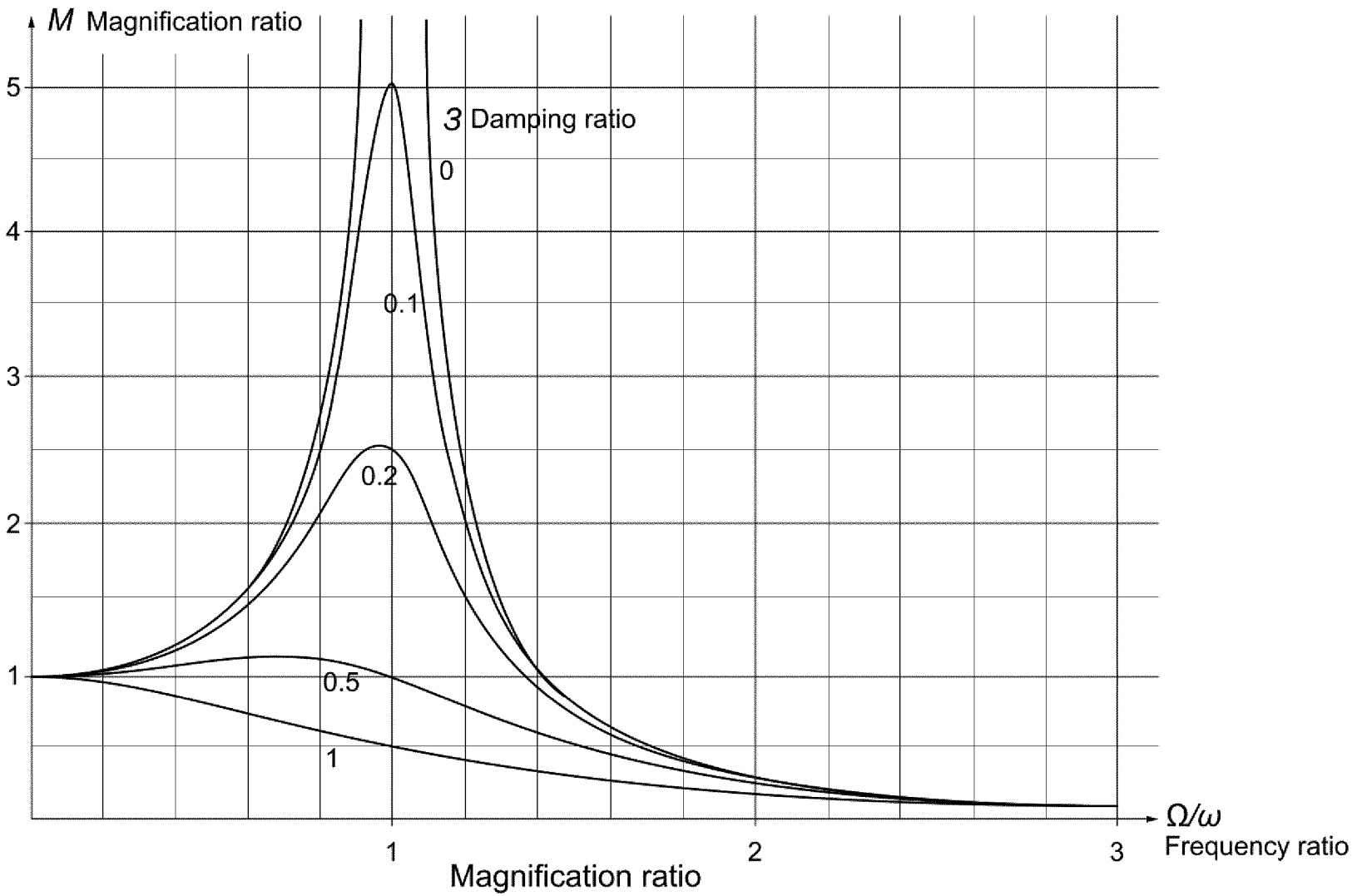
FIG. 3 is an illustrative graph of frequency ratio (Q/w) versus magnification factor (M) for a range of damping ratios (Q.

This is shown in FIG. 3 graphed as frequency ratio (Ω/ω) versus magnification factor M for varying damping ratios ζ. The magnification reflects the dynamic amplification factor or dynamic load factor of the system. From the Figure it is seen that tuning the bottom hole assembly 11 towards Ω=ω, will provide the maximum magnification and dynamic amplification in the system with DAF>>1.

The flow modifier 24 will provide the forced frequency Ω in operation. This is typically 15 and 20 Hz for the Agitator™ supplied by NOV. The dynamic amplification tool 22 and tools 24, 23 suspended from it on the string 16, are designed to provide a natural frequency ω, wherein the frequency ratio Ω/ω is close to 1. The frequency ratio may be between 0.6 and 1.2. It can be seen that for a damping ratio, ζ=0, the magnification ratio M=>1.6.

Thus the amplitude of the vibration from the flow modifier 24, is magnified by at least 1.6 upon the system. In an embodiment, the frequency ratio is between 0.9 and 1.1. Therefore by tuning the system of the bottom hole assembly, to be close to or at the output frequency of the flow modifier, the system can be near or at resonance, causing a magnification of the amplitude of the vibration on the system. This amplification of the amplitude of vibration also occurs for the tuned arrangement of FIG. 2.

Figure 4:
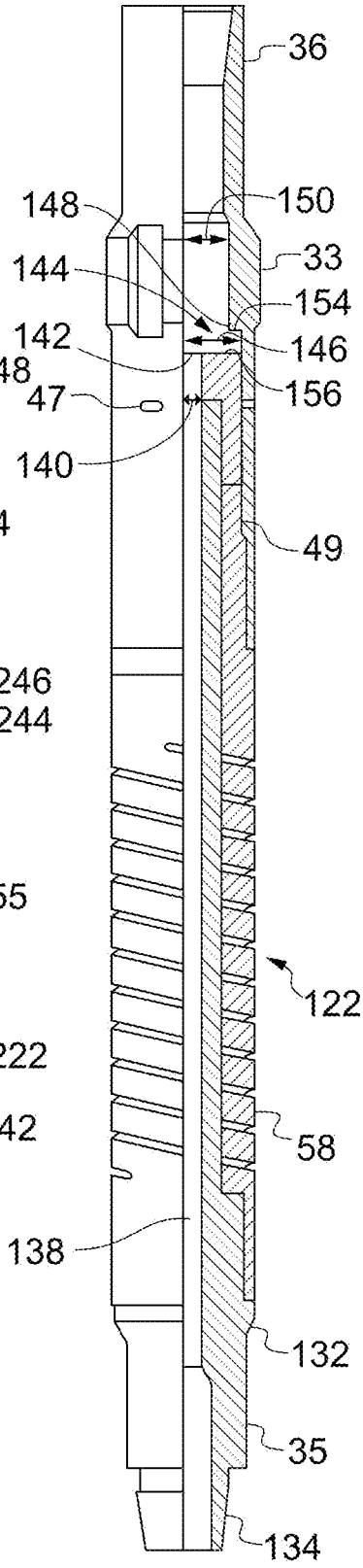
FIG. 4 is a cross-sectional view of a dynamic amplification tool according to an alternative embodiment of the present invention.

Reference is now made to FIG. 4 of the drawings which illustrates a dynamic amplification tool, generally indicated by reference numeral 122, for a spring/mass system according to a further embodiment of the present invention. In FIG. 4, reference numerals to parts shown in FIG. 2 have been given the same reference numeral with the addition of 100 to aid clarity. Tool 122 has a substantially cylindrical body 132 formed of an upper section 33 and a lower section 35. Arranged between the sections 33,35 around the outside of the body 132 is a machined spring 58. The spring 58 is arranged to act longitudinally on the tool 122. The lower section 35 extends under the spring providing a central bore 138 towards the first end 134 of the tool 122. At the end of the central bore 138, there is created an inlet 142 to a chamber 144 with a second diameter 146, being larger than the first diameter 140 of the central bore 138. The chamber 144 is formed from the upper section 33 stepped portion to narrow the bore to create the first wall 154 and an outlet 148 to the chamber 144. In this arrangement, the third diameter 150 is greater than the first diameter 140 but smaller than the second diameter 146. A second wall 156 is provided at the inlet 142 via an additional part between the upper and lower sections 33,35. Like the tool 22, a fluid passageway is provided through the tool 122 and the fluid does not have to directly move any part.

In use, the dynamic amplification tool 122 is tuned via the stiffness of the spring part 58 along with the mass of the assembly 11 below. When the flow modifier 24 provides the cyclic variation on fluid travelling through the bore 138, the effective pressure pulses reach the chamber 144 where they are captured and act on the tool body 132 so that the spring 158 will resonate at the frequency of the flow modifier 24. The arrangement of the chamber 144, has reduced the damping and as such the resonations set-up by the matched natural frequency of the bottom hole assembly 11 to the frequency output from the flow modifier, are amplified by the tool 122, causing substantial vibrations in tension applied to the point at which the anchor mechanism, slips 66, contact the inner wall 62 of the casing 12 to be recovered. Such vibrations are enhanced as the dynamic amplification factor of the system is much greater than one. The changes in tension applied to the casing 12 will cause agitation of the casing against the fixed debris 26 sufficient to break any bonds between them and free casing 12 for removal.

Unlike conventional tools the 'spring part' 58 of tool 122 can take tension as well as compression. This allows higher oscillatory loads than found in conventional shock subs before failure. If the spring 58 were to fail a load shoulder 49 is provided as a safety measure together with ports 47 which become exposed and would allow a pressure dump to occur to stop the flow modifier 24 operating. This would halt vibrations and allow the bottom hole assembly 11 to be retrieved. The presence of the spring 58 also reduces the length required in the bottom hole assembly 11 to resonate. There is no dependency on length and as such the pipe sections 21 are optional. This means that a bottom hole assembly 11 with a length of less than or around one stand can be provided which makes the assembly 11 easily handleable.

Figure 5:
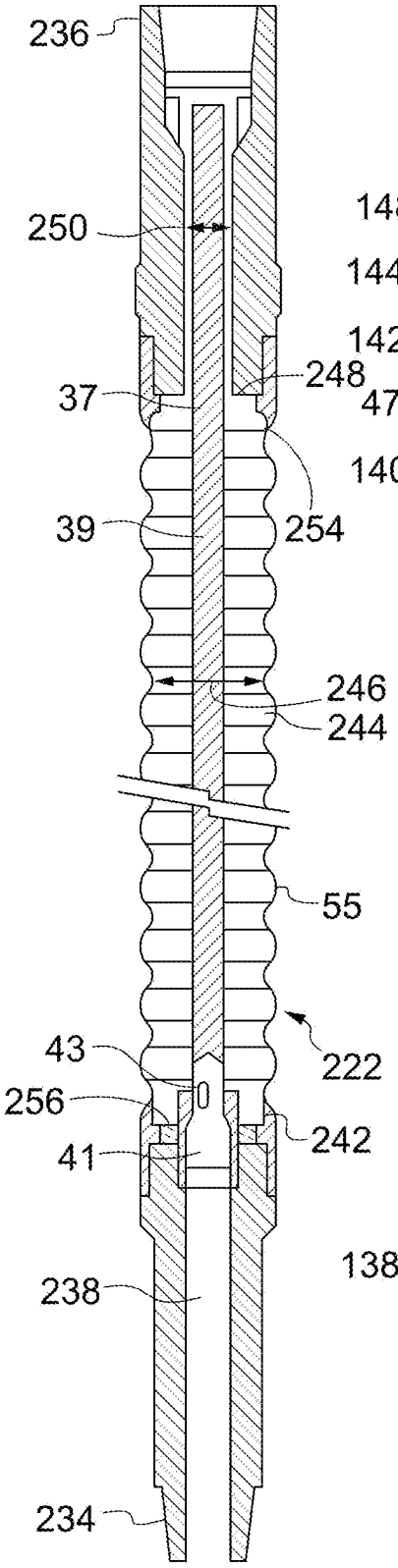
FIG. 5 is a schematic illustration of a vibratory casing recovery bottom hole assembly according to an embodiment of the present invention.

Reference is now made to FIG. 5 of the drawings which illustrates a dynamic amplification tool, generally indicated by reference numeral 222, according to a further embodiment of the present invention. In FIG. 5, reference numerals to parts shown in FIG. 2 have been given the same reference numeral with the addition of 200 to aid clarity. Like the tool 22 of FIG. 2, the tool 222 has a central bore 238 providing an inlet 242 and outlet 248 to a chamber 244 of wider diameter 246 and greater cross-sectional area than that of the bore 238, with opposing walls 254, 256 bounding the chamber 244. In this embodiment, the side wall 55 of the chamber 244 is not perfectly cylindrical as for the chambers 44,144 but is now profiled as undulations to provide bellows along a length of the tool 222. The bellows provide a spring part and a pressure chamber (seal less) together. As with the tool 122 the bellows have a stiffness which is tuned to the frequency of the flow modifier 24 in conjunction with the mass of the bottom hole assembly 11. The profile is designed and side wall thickness is varied to achieve the correct stiffness with the minimum stress. The 'spring part' can take tension as well as compression so the bellows can take higher oscillatory loads than conventional shock subs before failure occurs. The length of the chamber 244 required provides for a bottom hole assembly 11 which is manageable being less than one stand as pipe sections 21 are not required.

A further optional feature is provided in the tool 222, which can be provided in the dynamic amplification tool. This feature is a catcher 37. Catcher 37 is a rod 39 extending through chamber 244 which is fixed at the inlet 242 to block the inlet. There is a partial bore 41 towards the first end 234 which provides a fluid pathway from the central bore 238, via radial ports 43 at the partial bore 41, to the chamber 244. The rod 39 extends through the outlet 248 but has a narrower diameter than the second 246 and third 250 diameters so that fluid can flow out of the tool 222, thereby maintaining a fluid passageway between the ends 234, 236 of the tool 222. The catcher 37 gives a signal at surface if it fails and prevents objects dropped through the string 16 from reaching the flow modifier 24.

For each of the dynamic amplification tools described, a single chamber has been shown. It will be realised that multiple dynamic amplification tools or a single dynamic amplification tool with multiple chambers could be used. Additionally, while an inlet and outlet are referred to for the chamber, fluid flow is from surface but the pressure pulses appear from below, so the inlet and outlet are with reference to the pressure pulses.

As shown in FIG. 1(*a*) the casing spear 20 is anchored to the cut casing section 12 by slips 66. The dynamic amplification tool 22 is mounted below the casing spear 20 being separated from the casing spear 20 by one or more pipe sections 21 as required. The dynamic amplification tools 122, 222 could equally be used in the same arrangement, but the pipe sections 21 would not be required. As the string 16 is raised, flow through the string 16 and assembly 11 via a throughbore 68 will operate the flow modifier 24 and induce movement in the dynamic amplification tool 22 as fluid pulses act in the chamber 44, and the system will vibrate at a natural frequency near or equal to the forcing frequency from the flow modifier 24. Consequently, the dynamic load applied at the anchor point where the slips 66 grip the casing 12, is maximised as the tension varies on the casing 12 at near resonance. The dynamic amplification factor ((dynamic load+static load)/(static load)) is therefore also maximised with the result that the maximum vibratory energy that can be created by the dynamic amplification tool 22 is transmitted to the casing spear and onto the casing 12. The movement induced on the casing 12 by the vibration is used in dislodging the stuck material 26 to free the casing 12 and so aid recovery of the casing 12.

In the embodiment shown the string 16 also comprises a hydraulic jack 18. The hydraulic jack 18 is located above the casing spear 20 and a pressure drop sub may be located below the casing cutter 23 form part of the vibratory casing recovery bottom hole assembly 11.

The hydraulic jack 18 has an anchor 28 and an actuator system which pulls an inner mandrel 30 up into a housing of the jack 18. In a preferred embodiment the hydraulic jack is the DHPT available from Ardyne AS. It is described in U.S. Pat. No. 8,365,826, the disclosure of which is incorporated herein in its entirety by reference.

The anchor 28 of the jack 18, like the casing spear 20, has a number of slips 52 which are toothed to grip an inner surface 60 of the casing 14.

A pressure drop sub or valves can be used to create a build-up of fluid pressure in the throughbore 68 when fluid is pumped down the string 16. This is used to create pressure at the jack 18 for operating the hydraulic jack 18.

In a casing recovery operation, the string 16 is run into the well 10 with the flow modifier 24, dynamic amplification tool 22, pipe sections (if required) and casing spear 20 being run-in the casing 12. The string 16 is raised to a position to operate the switch on the casing spear 20 and the slips 66 automatically engage the inner surface 62 of the casing 12 at the upper end 64 thereof. At this stage the string 16 can be pulled via the top drive/elevator to see if the casing 12 is stuck. Fluid pumped down the string 16 will operate the flow modifier 24 and create vibration of the bottom hole assembly 11. As the dynamic amplification tool 22 is tuned to be at or near the frequency of the output of the flow modifier 24, an enhanced vibratory force will be experienced by the cut section of casing 12. Raising the string 16 can be done again to see if the material 26 has been dislodged sufficiently to allow the casing 12 to be recovered. If the casing 12 still does not move then the downhole pulling tool i.e. jack 18 is operated.

Referring now to FIG. 1(*b*), slips 52 on the anchor 28 of the hydraulic jack 18 are operated to engage the inner surface 60 of the outer casing 14. As with the casing spear 20, an overpull on the string 16 will force the teeth on the slips 52 into the surface 60 to provide anchoring.

With fluid flowing down a throughbore 68 of the string 16, the pressure of the fluid will build up by virtue of restrictions at nozzles of the pressure drop sub. At the same time, the fluid flow through the flow modifier 24 will create pressure pulses seen as a cyclic variation of pressure and consequently applied load via the dynamic amplification tool 22. The flow modifier 24 provides output at a frequency of less than 20 Hz and preferably between 15 and 20 Hz. The dynamic amplification tool 22 is induced to oscillate at this frequency and as it closely matches the natural frequency of the sub 22 and tools suspended therefrom it will resonate the bottom hole assembly 11 causing periodic or cyclical loading on the casing 12 via the slips 66 of the casing spear 20. The amplitude of the cyclic variations is determined by the dynamic amplification factor of the assembly 11 via the dynamic amplification tool 22 due to the mass of assembly 11 below the anchor mechanism, slips 66, to determine the axial extent of the oscillatory movement on the assembly 11 and casing 12.

Build-up of fluid pressure at the hydraulic jack 18 creates a fluid pressure which is sufficient to move inner pistons within the jack, so forcing the inner mandrel 30 upwards into the housing 32. As the inner mandrel 30 is connected to the casing spear 20 which is in turn anchored to the length of casing 12, the force on the length of casing will match the applied load of the pressure. This force is a large static load used to raise the assembly 11 and cut section of casing 12 and should be sufficient to release the casing 12 and allow it to move. At the same time, the casing 12 will vibrate or axially oscillate at or near the resonant frequency by virtue of the dynamic amplification tool 22, together with the pipe sections 21 or tools suspended therefrom for dynamic amplification tools 122,222, being tuned to the output frequency of the flow modifier 24. Such vibration has been shown to assist in releasing stuck casing and thus this action can assist during the pulling of the casing 12 by the jack 18.

It is hoped that the jack 18 can make a full stroke to give maximum lift to the casing 12. This is illustrated in FIG. 1(*c*). If the casing 12 is still stuck only a partial stroke will be achieved. In either case, the anchor 28 is unset, by setting down weight, as shown in FIG. 1(*d*).

Raising the string 16 will now lift the housing 32 with respect to the inner mandrel 30, to re-set the jack 18 in the operating position as illustrated in FIG. 1(*a*). This is now shown in FIG. 1(*e*) with the casing 12 now raised in the casing 14. As the string 16 is raised, the casing 12 may be free and then the entire apparatus 11 and the length of casing 12 can be recovered to surface and the job complete.

If the casing 12 remains stuck, the anchor 28 is re-engaged as illustrated in FIG. 1(*f*) and the steps repeated as described and shown with reference to FIGS. 1(*b*) to 1(*e*). The steps can be repeated any number of times until the length of casing 12 is free and can be pulled to surface by raising the string 16 using the top drive/elevator on the rig.

As long as fluid is pumped down the throughbore 68, the flow modifier 24 and dynamic amplification tool 22 will operate and resonant axial movement is induced in the assembly 11 to aid casing removal.

It will be appreciated by those skilled in the art that the use of the hydraulic jack 18 and pressure drop sub 24 is optional and the casing 12 may be recovered using only the casing spear 20 with the flow modifier 24 and dynamic amplification tool 22 in the bottom hole assembly 11. Additionally, any devices which cause periodic axial loading on the anchor point can be used as the flow modifier 24 and dynamic amplification tool 22.

It is also known that for the Agitator™ flow modifier 24, that the frequency induced on the fluid can be varied by varying the speed of the fluid through the fluid modifier 24. Thus varying the pump rate at surface can provide small variations in the forced frequency from the flow modifier. Such variation can be made to fine tune the bottom hole assembly 11 to match the natural frequency and achieve maximum resonance and the highest available dynamic amplification factor.

The principle advantage of the present invention is that it provides a vibratory casing recovery assembly which dynamically amplifies vibrations created in the assembly to aid casing recovery.

A further advantage of the present invention is that it provides a vibratory casing recovery assembly in which the bottom hole assembly is tuned to the frequency output of a fluid modifier to create resonance in the assembly.

A further advantage of the present invention is that it provides a method of vibratory enhanced casing recovery which increases cyclical loading on the casing to help dislodge material behind the casing.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended with the invention being defined within the scope of the claims.

We claim:

1. A vibratory casing recovery assembly, comprising:

a bottom hole assembly (BHA), configured to be suspended from an anchor mechanism on a fluid carrying string, the BHA comprising:

a flow modifier for producing cyclic variations at a first frequency in the pressure of fluid through the string, and a dynamic amplification tool adapted to cause axial movement in the bottom hole assembly in response to variations in the flow of fluid through the string;

the dynamic amplification tool being arranged between the anchor mechanism and the flow modifier; and the dynamic amplification tool being configured to provide a natural resonant frequency in the bottom hole assembly wherein:

$$0.6<\text{first frequency}/\text{natural frequency}<1.2$$

to provide a dynamic amplification factor of >1.

2. The vibratory casing recovery assembly according to claim 1 wherein:

$$0.9<\text{first frequency}/\text{resonant frequency}<1.1.$$

3. The vibratory casing recovery assembly according to claim 1 wherein the flow modifier comprises a rotating valve.

4. The vibratory casing recovery assembly according to claim 1 wherein the dynamic amplification tool comprises a tool body having a first end and a second end each configured for connection into the bottom hole assembly, the tool body including a chamber, the chamber including at least one inlet and at least one outlet to provide a fluid passageway through the dynamic amplification tool, between the first end and the second end, and the chamber including at least one wall on which modified fluid flow can act.

5. The vibratory casing recovery assembly according to claim 4 wherein the at least one wall is arranged substantially perpendicular to a longitudinal axis of the dynamic amplification tool and the bottom hole assembly.

6. The vibratory casing recovery assembly according to claim 5 wherein there is a first wall and a second wall of the chamber, the walls being arranged opposite each other.

7. The vibratory casing recovery assembly according to claim 4 wherein the chamber has a cross-sectional area, perpendicular to the longitudinal axis, which is greater than the cross-sectional flow area in the remainder of the tool body.

8. The vibratory casing recovery assembly according to claim 1 wherein a length of the bottom hole assembly between the anchor mechanism and the flow modifier is selected to create the natural frequency of the bottom hole assembly at the first frequency.

9. The vibratory casing recovery assembly according to claim 8 wherein the selected length includes selecting a length of the chamber along the longitudinal axis.

10. The vibratory casing recovery assembly according to claim 9 wherein the chamber length is tuned to be a portion of the wavelength of the speed of sound in the fluid being an integer number of half wavelengths.

11. The vibratory casing recovery assembly according to claim 10 wherein the chamber length is tuned to be an integer number of quarter wavelengths.

12. The vibratory casing recovery assembly according to claim 8 wherein the selected length includes incorporating one or more sections of pipe in the bottom hole assembly.

13. The vibratory casing recovery assembly according to claim 12 wherein the dynamic amplification tool comprises six joints of tubing between the flow modifier and the anchor mechanism.

14. The vibratory casing recovery assembly according to claim 1 wherein a stiffness of the dynamic amplification tool is tuned, together with the mass of the bottom hole assembly, to select the natural frequency at the first frequency.

15. The vibratory casing recovery assembly according to claim 14 when wherein a spring is located around a side wall of the chamber and arranged to act along a length of the chamber.

16. The vibratory casing recovery assembly according to claim 15 wherein the spring has a stiffness tuned to the first frequency.

17. The vibratory casing recovery assembly according to claim 14 wherein a side wall of the chamber is configured as bellows.

18. The vibratory casing recovery assembly according to claim 17 wherein the bellows have a stiffness tuned to the first frequency.

19. The vibratory casing recovery assembly according to claim 1 wherein the bottom hole assembly includes a casing cutter.

20. The vibratory casing recovery assembly according to claim 1 wherein the vibratory casing recovery assembly includes the anchor mechanism and the anchor mechanism is a casing spear.

21. The vibratory casing recovery assembly according to claim 1 wherein the vibratory casing recovery assembly includes a downhole pulling tool on the string above the anchor mechanism.

22. The method of casing recovery in a wellbore, comprising the steps;

(a) running a string into the wellbore, the string including a vibratory casing recovery bottom hole assembly comprising:

a bottom hole assembly (BHA), configured to be suspended from an anchor mechanism on a fluid carrying string, the BHA comprising:

a flow modifier for producing cyclic variations at a first frequency in the pressure of fluid through the string, and a dynamic amplification tool adapted to cause axial movement in the bottom hole assembly in response to variations in the flow of fluid through the string;

the dynamic amplification tool being arranged between the anchor mechanism and the flow modifier; and the dynamic amplification tool being configured to provide a natural resonant frequency in the bottom hole assembly wherein:

$$0.6 < \text{first frequency}/\text{natural frequency} < 1.2$$

to provide a dynamic amplification factor of >1;

(b) setting the anchor mechanism to an inner wall of the casing;

(c) pumping fluid from surface through the string to produce cyclic variations at the first frequency in the pressure of fluid through the string to induce vibration in and resonance of the bottom hole assembly; and (d) pulling the string and the vibratory casing recovery bottom hole assembly to recover the casing to be removed.

23. The method of casing recovery in a wellbore according to claim 22 wherein the method includes the step of varying the fluid flow rate through the string to adjust the first frequency.

24. The method of casing recovery in a wellbore according to claim 22 wherein the method includes providing a downhole pulling tool on the string above the anchor mechanism and using the downhole pulling tool to pull the bottom hole assembly and casing to be recovered before pulling the string to recover the casing.

25. The method of casing recovery in a wellbore according to claim 22 wherein the method includes the additional steps providing a casing cutter in the bottom hole assembly and cutting casing to provide a cut section of casing to be removed on the same trip as recovering the casing.

* * * * *